US005426848A

United States Patent [19]

Shibata et al.

[11] Patent Number: 5,426,848

[45] Date of Patent: Jun. 27, 1995

[54] APPARATUS FOR ATTACHING A SLIDER PULL TAB

[75] Inventors: Hiroki Shibata; Tatsumi Shirodera, both of Kurobe, Japan

[73] Assignee: Yoshida Kogyo K.K., Tokyo, Japan

[21] Appl. No.: 272,940

[22] Filed: Jul. 11, 1994

[30] Foreign Application Priority Data

Aug. 6, 1993 [JP] Japan ..... 5-231076

[51] Int. Cl.[6] ..... A41H 37/06; B21D 53/50

[52] U.S. Cl. ..... 29/766; 29/33.2; 29/409

[58] Field of Search ..... 29/766, 408, 409, 33.2

[56] References Cited

U.S. PATENT DOCUMENTS 2,354,690 8/1944 Lawson ..... 29/409
2,693,217 11/1954 Lange ..... 29/409
2,825,126 3/1958 Legat et al. ..... 29/409
4,051,710 10/1977 Kobayashi .
5,031,307 7/1991 Yoneda et al. ..... 29/766
5,067,221 11/1991 Oyama ..... 29/766
5,174,017 12/1992 Hatagishi ..... 29/766

*Primary Examiner*—P. W. Echols
*Attorney, Agent, or Firm*—Hill, Steadman & Simpson

[57] ABSTRACT

An apparatus for attaching pull tabs automatically one at a time onto a slider body comprises a pull tab transport unit, a clamper applying unit and a clamping unit. The transport unit includes a pull tab supply chute having a pair of guide rails defining therebetween a guide slit adjustable depending upon the size of a connecting link of a pull tab. A transfer conveyor operatively associated with the clamper applying unit is movable multidirectionally to move and set the pull tab in position during the attachment operation.

6 Claims, 5 Drawing Sheets

APPARATUS FOR ATTACHING A SLIDER PULL TAB

BACKGROUND OF THE INVENTION

1. Field of the Invention

This invention relates to an apparatus for attaching a pull tab onto a slider body to provide a slide fastener slider.

2. Prior Art

There have been proposed numerous devices for attaching pull tabs to associated slider barrels which are separately fabricated.

To the best of the inventors' knowledge, such pull tab attachment devices known to date were manually operated as exemplified for instance in Japanese Utility Model Publication No. 56-37611 which discloses clenching a pull tab to a ring member on a slider body with use of a manual clamping tool.

Such conventional pull tab attachment operation by hand was not only literally time-consuming and tedious, but also would entail difficulty in achieving a uniform and neat finish of joint between the pull tab and the slider body.

SUMMARY OF THE INVENTION

With the foregoing difficulties of the prior art in view, the present invention seeks to provide a novel apparatus for attaching a pull tab to its associated slider body substantially automatically with utmost efficiency and accuracy.

This and other objectives and features of the invention will became apparent from the following detailed description taken in connection with the accompanying drawings.

According to the invention, there is provided an apparatus for attaching a pull tab onto a slider body which comprises a pull tab transport unit, a clamper applying unit and a clamping unit, the pull tab transport unit including a pull tab transfer chute having a pair of elongate guide rails, defining therebetween a longitudinal guide slit for receiving a series of pull tabs and a transfer conveyor movable multi-directionally to transfer pull tabs intermittently one at a time through the chute; the clamper applying unit including a slider supply chute, a slider holder movable toward and away from the pull tab chute for releasably holding the slider during attachment thereof to the pull tab, a slider transfer means for transferring sliders one at a time from the chute onto the slider holder and a slider arrestor movable toward and away from the slider chute for preventing the slider S from falling apart from the pull tab; and the clamping unit including a clamping punch for clamping the pull tab together with the slider (S).

DETAILED DESCRIPTION OF THE INVENTION

Figure 1:
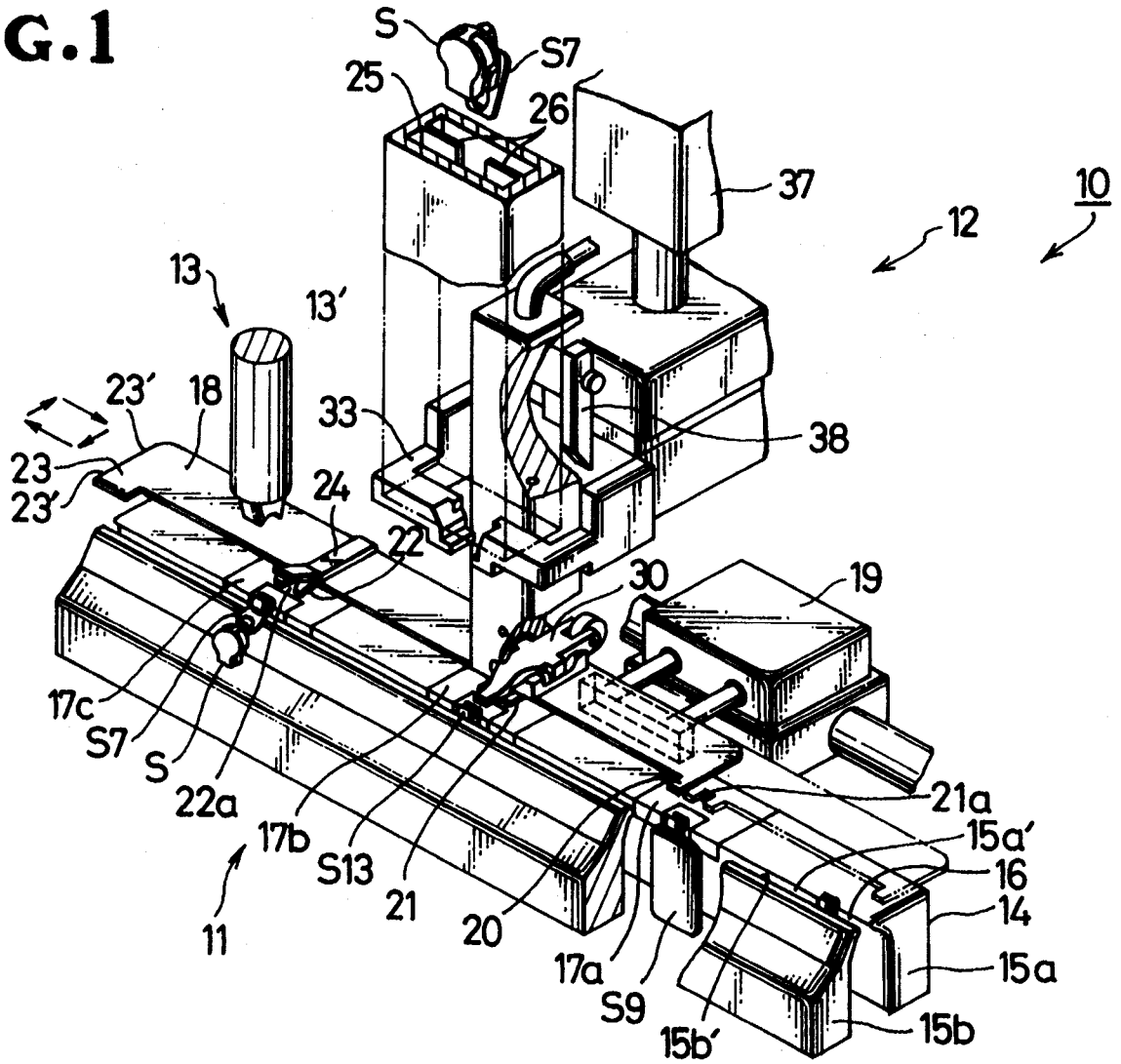
FIG. 1 is a perspective view of a pull tab attachment apparatus embodying the invention.

Referring now to the drawings and FIG. 1 in particular, there is shown a pull tab attachment apparatus 10 which essentially comprises a pull tab transport unit 11, a clamper applying unit 12 and a clamping unit 13.

Figure 8:
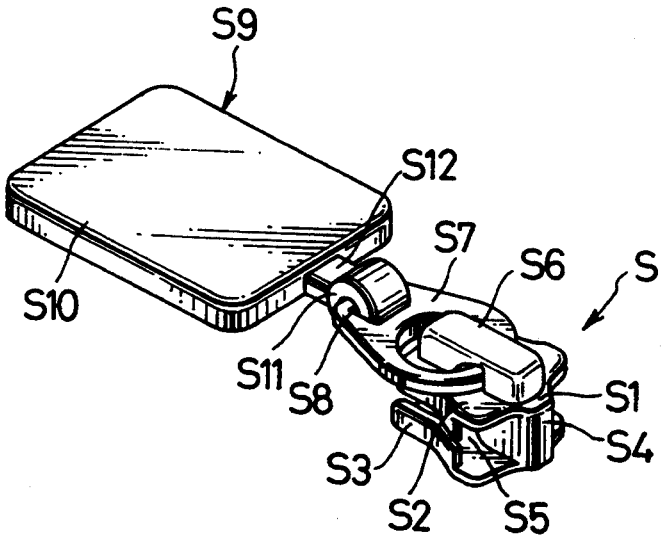
FIG. 8 is a perspective view of a slider shown assembled.

Before going into detailed description of the apparatus 10, a slide fastener slider S to be assembled thereby will be described as to its construction with reference to FIG. 8. The slider S comprises a slider body $S_1$ having an upper wing member $S_2$ and a lower wing member $S_3$ joined together at one end by a head portion or "diamond" $S_4$ to define therebetween a guide channel $S_5$ for the passage therethrough of a pair of slide fastener stringers (not shown), a trunnion $S_6$ formed on the upper wing member $S_2$, a clamper $S_7$ pivotally connected to the trunnion $S_6$ and having an aperture $S_8$ at the opposite end, and a pull tab $S_9$ including a web portion $S_{10}$ and a coupling link $S_{11}$ rotatably received in the aperture $S_8$ of the clamper $S_7$, the link $S_{11}$ being connected by a neck portion $S_{12}$ to one end of the web portion $S_{10}$. This is only exemplary of one of many different forms of a slider which may be assembled by the apparatus 10 of the invention upon appropriate modification or change to some of its component parts.

The pull tab transport unit 11 comprises a pull tab transfer chute 14 having a pair of elongate horizontal guide rails 15*a* and 15*b* defining therebetween a longitudinal guide slit 16 for receiving a series of pull tabs $S_9$. The guide slit 16 is adjustable depending upon the type and size of the pull tab to be applied. Each pull tab $S_9$ is mounted in the slit 16 either manually or automatically with its coupling link $S_{11}$ hooked on the confronting inner longitudinal edges 15*a*', 15*b*' of the guide rails 15*a*, 15*b* and exposed above the upper surfaces thereof as shown in FIG. 1. The coupling link $S_{11}$ is split apart to provide an opening $S_{13}$ extending parallel with the plane of the web portion $S_{10}$ of the pull tab $S_9$ and with the guide slit 16 for receiving and connecting the clamper $S_7$ of the slider S in a manner hereinafter to be described.

The chute 14 is provided with a plurality of pull tab retainers 17 including a first retainer 17*a*, a second retainer 17*b* and a third retainer 17*c* at predetermined intervals along the inner longitudinal edge 15*a*' of one of the guide rails, which is the right-hand side rail 15*a* according to the presently illustrated embodiment in FIG. 1 for normally resiliently holding the link $S_{11}$ of the pull tab $S_9$ against the inner longitudinal edge 15*b*' of the opposed mating rail 15*b*.

The pull tab transport unit 11 includes a transfer conveyor 18 in the form of an elongate horizontal plate and a drive means 19 designed to effect multi-directional movements of the conveyor 18 as indicated by the arrows in FIG. 1 in which the conveyor 18 is reciprocally movable in both longitudinal and transverse directions; i.e, along a rectangular path in a manner hereinafter to be described.

The conveyor 18 is provided at predetermined intervals along its inner longitudinal edge with a first engaging lug 20 at one extreme end, a second engaging lug 21, a third engaging lug 22 and a fourth engaging lug 23 which are spaced a substantially equal distance apart from each other. The second and third engaging lugs 21 and 22 are each bifurcated to provide respective recesses 21*a* and 22*a* dimensioned to hold the link $S_{11}$ of the pull tab $S_9$ firmly in place during attachment to its associated slider body. The multidirectional movement of the conveyor 18 will now be described with reference to FIG. 1.

A first longitudinal forward stroke of the conveyor 18 in the leftward direction as viewed in the drawing causes the first engaging lug 20 to bring the pull tabs $S_9$ one at a time over to a standby position defined by the first retainer 17*a* of the chute 14, whereupon the conveyor 18 makes a short transverse retractive movement toward the drive means 19 away from the guide slit 16 and then moves longitudinally backward in the rightward direction until the second engaging lug 21 registers with the first retainer 17*a*, followed by a short transverse ingressive movement toward the guide slit 16 away from the drive means 19 to receive the link $S_{11}$ of the pull tab $S_9$ into the second engaging lug 21. This is followed by a second longitudinal forward stroke of the conveyor 18 to bring the pull tab $S_9$ over to a clamper applying position defined by the second retainer 17*b* wherein the pull tab $S_9$ is connected to the slider S in a manner hereinafter to be described. The conveyor 18 then retracts transversely away from the guide slit 16 and moves longitudinally backward until the third engaging lug 22 registers with the second retainer 17*b* and captures the pull tab $S_9$ as connected with the slider S, followed by a third longitudinal forward stroke to bring the combined but unclamped pull tab and slider assembly over to a clamping position defined by the third retainer 17*c* wherein the link $S_{11}$ of the pull tab $S_9$ is clamped to close the opening $S_{13}$ with the conveyor 18 retracted away from the guide slit 16 in a manner hereinafter to be described. The conveyor 18 is provided with a covering strip 24 overlying and slightly projecting beyond the tip end of the third engaging lug 22 for connecting the opening $S_{13}$ of the pull tab $S_9$, which has been connected to the clamper $S_7$ of the slider S, and thus protecting the slider S against separation from the pull tab $S_9$ during movement from the clamper applying position to the clamping position.

Upon completion of the clamping operation, the conveyor 18 makes a longitudinal backward movement to bring the first engaging lug 20 back to the original position indicated by the phantom line in FIG. 1 for receiving the next pull tab $S_9$, in which position the fourth engaging lug 23 has moved slightly past the clamping position with its outer end 23' located closely adjacent to the upstream side of the assembled slider. Subsequently, the conveyor 18 makes a short ingressive or transverse movement toward the guide slit 16, followed by a fourth longitudinal forward stroke to withdraw the assembled slider out of the machine for inventory simultaneously as the first engaging lug 20 delivers the next pull tab $S_9$ to the standby position at the first retainer 17*a* to repeat the cycle of the foregoing pull tab attachment operation.

Designated at 25 is a vertically extending slider chute having a pair of spaced parallel support rails 26, 26 defining therebetween a gap for receiving a series of pull tab-free sliders S which are fed by their own gravity from a supply hopper (not shown). On the front side of the slider chute 25 and above the guide rail 15*b* is situated a slider transfer means 27 for transferring sliders S in the chute 25 one at a time to a slider holder later described. The slider transfer means 27 comprises a pair of vertically spaced parallel transfer rods 28 and 29 which are alternately reciprocally movable toward and away from the path of a vertical row of sliders S in the chute 25. The first transfer rod 28 moves into the chute 25 to receive thereon a leading one of the sliders S, while the second transfer rod 29 is retracted from the chute 25 as better shown in FIG. 2. The second rod 29 moves toward and into the chute 25 to receive the next ensuing slider prior to releasing the leading slider by retractive movement of the first rod 28 and then retracts away from the chute 25 to release and relay the next slider onto the first rod 28 when the latter has moved again into the chute 25. Thus, alternate reciprocal movement of the two transfer rods 28, 29 is timed to effect the delivery of sliders one at a time through the chute 25 to the clamper applying unit 12.

Designated at 30 is a slider arrestor having a pedestal 31 located beneath the first transfer rod 28 for preventing the slider S against falling apart from the pull tab $S_9$ during attachment. The stopper 30 is normally urged by a spring 32 to retract away from the path of sliders in the chute 25.

The clamper applying unit 12 comprises a slider holder 33 having a pair of gripping jaws 34, 34 movable toward and away from each other for releasably holding a slider S.

Designated at 35 is a slider stopper normally biased by a spring 36 toward the path of sliders S in the chute 25 for receiving the coming slider and assisting in positioning the slider properly in the slider holder 33.

Figure 3:
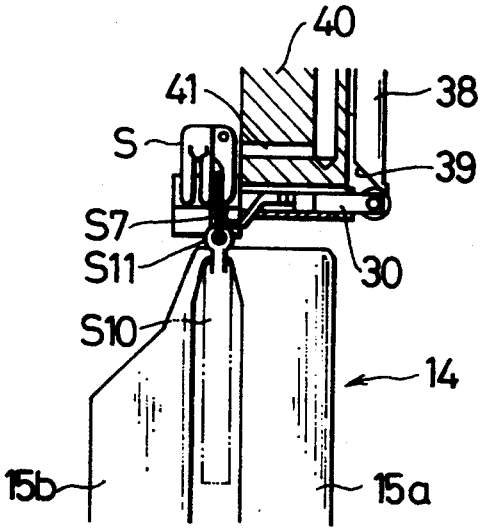
FIG. 3 is a side elevational, partly sectional, view of a portion of the apparatus of FIG. 1 shown in one operative mode.
Figure 4:
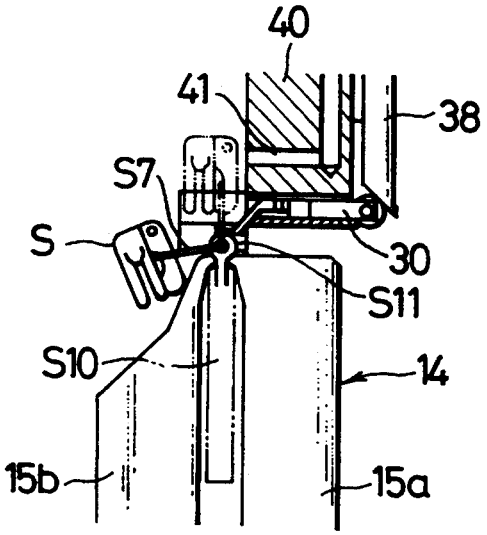
FIG. 4 is a view similar to FIG. 3 but showing the apparatus in another operative mode.

Designated at 37 is a pneumatically or hydraulically operated cylinder for moving the slider holder 23 vertically toward and away from the pull tab supply chute 14 and provided with a camming means 38 having a cam surface 39 engageable with the slider arrastor 30 for causing the latter to move horizontally inwardly toward the path of pull tabs $S_9$ defined by the guide slit 16 of the chute 14 against the tension of the spring 32 as shown in FIGS. 3 and 4.

Designated at 40 is an air compressor interposed between the slider supply chute 25 and the cylinder 37 and having an air jet nozzle 41 opening toward the path of sliders S in the chute 25.

Figure 2:
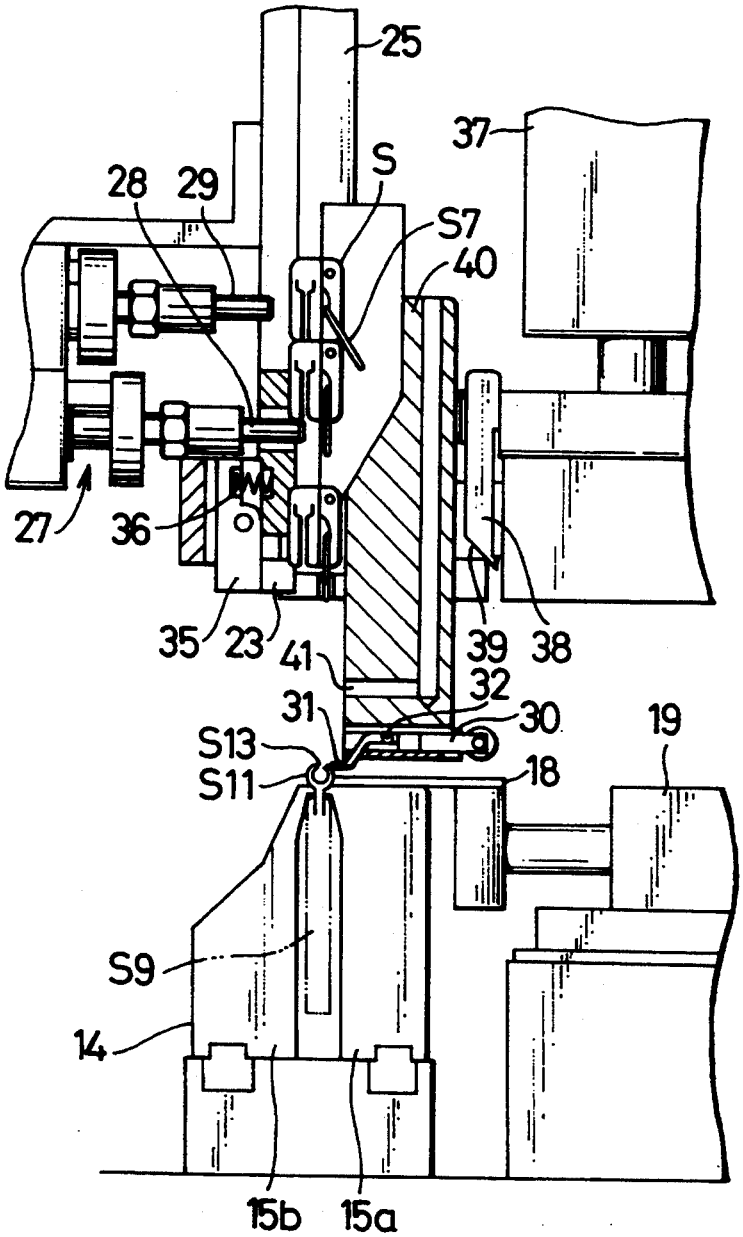
FIG. 2 is a side elevational, partly sectional, view of the same.
Figure 5:
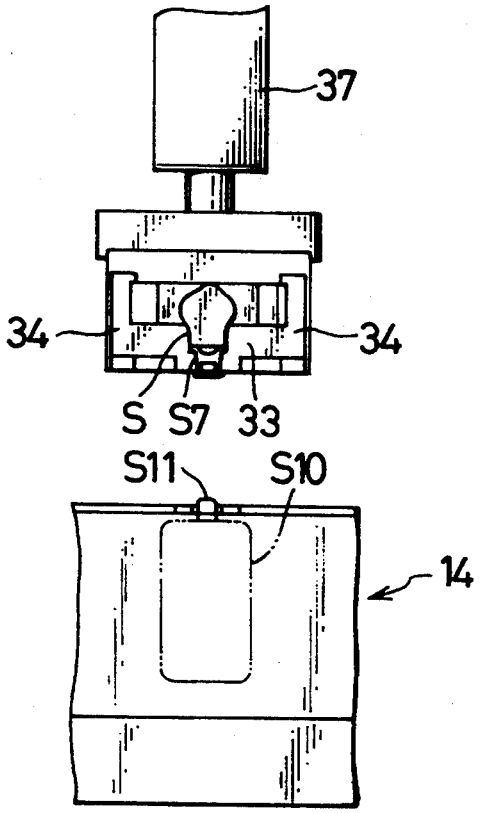
FIG. 5 is a frontal elevational view of a portion of the apparatus shown in one operative position.
Figure 6:
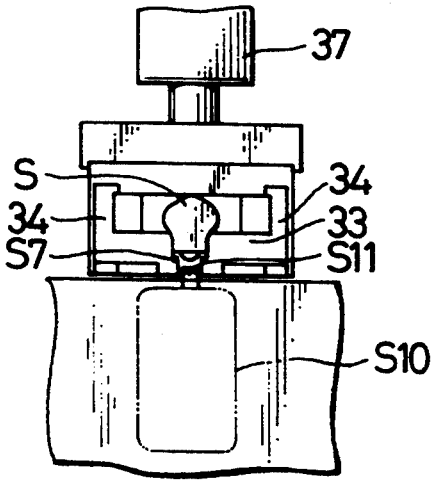
FIG. 6 is a view similar to FIG. 5 but showing the apparatus in another operative position.
Figure 7:
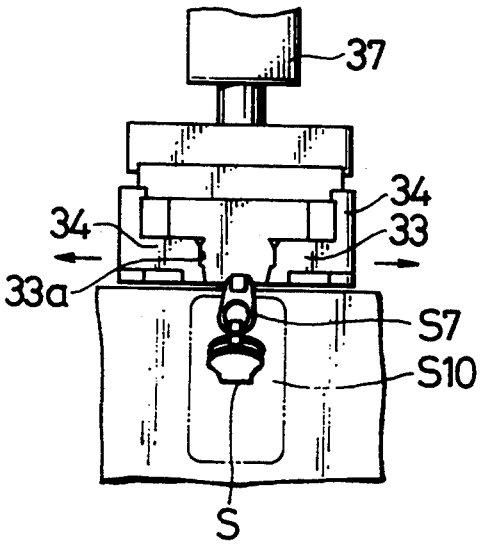
FIG. 7 is a view similar to FIG. 6 but showing the apparatus in still another operative position.

With the clamper applying unit 12 thus constructed, the leading slider S is transferred from the first transfer 28 rod to and received on the slider stopper 35 and seated in a nest 33*a* (FIG. 7) formed by the confronting inner surfaces of the gripping jaws 34, 34 and configured to stably receive the slider S and its clamper $S_7$ as shown in FIG. 5. The slider holder 33 then descends from the position of FIG. 5 and reaches the position of FIG. 6 in which the clamper $S_7$ of the slider S is inserted through and in the opening $S_{13}$ of the link $S_{11}$ of the pull tab $S_9$ standing by in the chute 14, followed by engagement of the cam surface 39 with the slider arrestor 30 with the pedestal 31 arresting the clamper $S_7$ from falling apart from the pull tab $S_9$ as shown in FIG. 4. The gripping jaws 34, 34 are then moved apart to release the slider S as shown in FIG. 7 simultaneously as an air jet from the nozzle 41 acts upon and tilts or flips down the slider S from the phantom line position to the solid line position in FIG. 4 so as to be ready for subsequent clamping of the connecting link $S_{11}$ of the pull tab $S_9$. The slider holder now ascends retractively away from the pull tab chute 14 back to its original position (FIG. 2) for receiving the next slider in a row from the supply chute 25. This ascending movement brings the camming means 38 upwardly thereby releasing the slider arrestor 30 to retract by the action of the spring 32 to the original standby position (FIG. 2).

The slider and the pull tab thus coupled together as above are transferred by the conveyor 18 to the clamping unit 13 having a clamping punch 13' of a conventional form where the connecting link $S_{11}$ of the pull tab $S_9$ is clamped or clenched to close its opening $S_{13}$ so that the slider is securely connected with the pull tab. The slider thus finished is delivered out of the machine for storage.

Various changes and modifications may be made in the construction and form of the apparatus herein described without departing from the scope of the appended claims.

What is claimed is:

1. An apparatus for attaching a pull tab onto a slider body which comprises a pull tab transport unit, a clamper applying unit and a clamping unit, said pull tab transport unit including a pull tab transfer chute having a pair of elongate guide rails defining therebetween a longitudinal guide slit for receiving a series of pull tabs and a transfer conveyor movable multi-directionally to transfer pull tabs intermittently one at a time through said chute; said clamper applying unit including a slider supply chute, a slider holder movable toward and away from said pull tab chute for releasably holding the slider during attachment thereof to said pull tab, a slider transfer means for transferring sliders one at a time from said chute onto said slider holder and a slider arrestor movable toward and away from said slider chute for preventing the slider from falling apart from the pull tab; and said clamping unit including a clamping punch for clamping the pull tab together with the slider.

2. An apparatus according to claim 1 wherein said clamper applying unit further includes a camming means releasably engageable with said slider arrestor to move the latter into position for arresting the slider in engagement with the pull tab.

3. An apparatus according to claim 1 wherein said clamper applying unit further includes an air jet nozzle for tilting the slider relative to the pull tab upon connection by said slider holder.

4. An apparatus according to claim 1 wherein said slider transfer means further includes a slider stopper spring-biased toward said slider chute for receiving and positioning the slider relative to said slider holder.

5. An apparatus according to claim 1 wherein said transfer conveyor is movable along a rectangular path in which it makes a relatively long reciprocal movement longitudinal of said pull tab chute and a relatively short reciprocal movement transversely of said pull tab chute.

6. An apparatus according to claim 1 wherein said slider holder comprises a pair of gripping jaws movable toward and away from each other to hold and release the slider.

* * * * *